US005562289A

United States Patent [19]

McAllister

[11] Patent Number: 5,562,289

[45] Date of Patent: Oct. 8, 1996

[54] PADDLE AND BAT BALL GAME

[76] Inventor: Jack G. McAllister, 808 First Ave. South, Buffalo, Minn. 55313

[21] Appl. No.: 489,081

[22] Filed: Jun. 9, 1995

[51] Int. Cl.[6] ..... A63B 71/02

[52] U.S. Cl. ..... 273/411; 273/342; 273/402

[58] Field of Search ..... 273/411, 401, 273/402, 342

[56] References Cited

U.S. PATENT DOCUMENTS

| | | | |
|---|---|---|---|
| D. 248,883 | 8/1978 | McAllister | D21/211 |
| D. 348,499 | 7/1994 | McAllister | D21/211 |
| 1,419,554 | 6/1922 | Ganse | 273/400 |
| 1,547,222 | 7/1925 | Lynch | 273/342 |
| 2,964,321 | 12/1960 | Anderson | 273/411 |
| 3,048,399 | 8/1962 | Breitbach | 273/72 |
| 3,091,461 | 5/1963 | Taylor | 273/341 |
| 3,366,386 | 1/1968 | Lindholm et al. | 273/318 |
| 3,469,844 | 9/1969 | Sindelar | 273/402 X |
| 3,923,304 | 12/1975 | Warren | 373/398 |
| 3,941,384 | 3/1976 | Wopschall | 446/220 X |
| 3,948,521 | 4/1976 | Warren | 273/393 |
| 3,990,702 | 11/1976 | Chopp | 273/412 |
| 3,994,497 | 11/1976 | Cordingley | 273/411 X |
| 5,098,109 | 3/1992 | Wayne | 273/400 |
| 5,209,493 | 5/1993 | Chernek | 273/411 |
| 5,297,798 | 3/1994 | Davila-Hernandez | 273/342 |

*Primary Examiner*—William H. Grieb

[57] ABSTRACT

A base running ball game has combined paddle and bat implements to hit a ball. Offensive players use the combined paddle bat to hit the ball into a fairfield occupied by defensive players. Some of the defensive players use the combined paddle and bat implement to field the batted ball and send the ball into safe areas of bases. A put out is made when the ball lands in the safe area of a base in front of a batter running to the base.

16 Claims, 3 Drawing Sheets

PADDLE AND BAT BALL GAME

FIELD OF THE INVENTION

The invention relates to games and recreational equipment for use in bunkerball or combined baseball and tennis type of sports.

1. Background of the Invention

The combination of a racquet or paddle and ball for use in playing games is well known in the art. For example, J. Warren in U.S. Pat. No. 3,948,521, issued Apr. 6, 1976, discloses a game and apparatus that includes a paddle type of bat which is used to hit a ball. The ball is used by players to knock off a second ball from a center post located within a ringed playing area. A batting player positioned within the ring uses the bat to prevent this occurrence.

1. Summary of the Invention

The invention is directed to a modified baseball/tennis type of game having offensive players that bat a ball toward a playing field with a combined paddle and bat. Defensive players or fielders collect balls hit into the fairfield of a playing area and attempt to put out offensive players running between bases.

The game and apparatus is for first and second teams of players. The apparatus comprises a first base or bunker for a home safe area. A second bunker is used for a first safe area and a third bunker is used for a second safe area. A combined paddle and bat is used by players of the first team for hitting a ball. A playing surface provides a playing field for the teams of players. The playing field has an infield and a fairfield adjacent one side of the infield. The players of the first team sequentially use the combined paddle and bat to hit the ball into the infield or fairfield and then run from the first bunker to the second bunker. The players of the second team are positioned in the infield and fairfield. The players positioned in the infield manually collect the ball and throw the ball to the safe area of the second bunker in front of the player of the first team running to the second bunker. The player of the first team is safe at the second bunker if the ball does not land in the safe area of the second bunker before the player of the first team contacts the second bunker and out if the ball lands in the safe area of the second bunker before the player of the first team contacts the second bunker. The players positioned in the fairfield collect the ball in the event the ball is hit to the fairfield. The players in the fairfield use combined paddle and bats to hit the ball toward the safe area of the second bunker in front of the player of the first team running to the second bunker. The player of the first team is safe at the second bunker if the ball does not land in the safe area of the second bunker and out if the ball lands in the safe area of the second bunker before the player reaches the second bunker.

DESCRIPTION OF THE PREFERRED EMBODIMENTS

Figure 1:
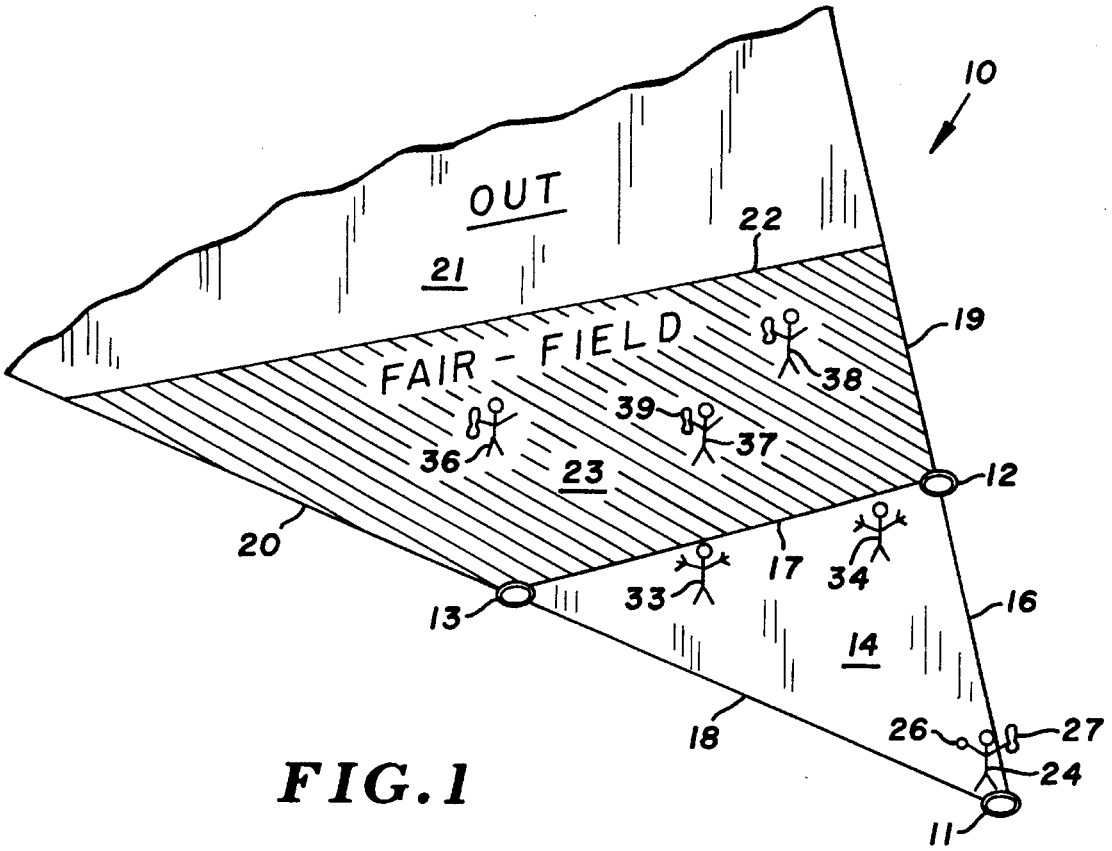
FIG. 1 is a diagrammatic view of the playing field of the paddle and bat ball game of the invention.

Referring to FIG. 1, there is shown a game and apparatus of the invention for a paddle and bat ball game. The game and apparatus requires a playing surface with a playing field, indicated generally at 10. An offensive team of players 24 use a combined paddle and bat 27 to hit a ball 26 toward playing field 10 and then run around bunkers 11, 12 and 13. A team of defensive players 33, 34, 36, 37 and 38 field batted ball 26 and send ball 26 into bunkers 11, 12 and 13 ahead of players 24 to put out players 24 running to the bunkers.

Playing field 10 has a home base or bunker 11, first bunker 12, and second bunker 13 located on corners of a triangular shaped infield 14. A generally linear running or bunker path 16 connects home bunker 11 with first bunker 12. Linear bunker path 17 connects first bunker 12 with second bunker 13 and bunker path 18 connects second bunker 13 with home bunker 11. Bunker paths 16, 17 and 18 have the same lengths, such as 50 feet per path. Other dimensions may be used. Foul or out lines 19 and 20 angularly extend from home bunker 11 forming linear extensions of bunker paths 16 and 18, respectively. A transverse out line 22 intersects out lines 19 and 20. Transverse out line 22 is located generally parallel to bunker path 17. Bunker path 17 and out lines 19, 20 and 22 form a trapezoidal shaped fairfield 23 adjacent one side of infield 14. An outfield 21 is located beyond transverse out line 22. Out lines 19, 20 and 22 have the same lengths, such as 100 feet. Other dimensions may be used. Playing field 10 can have other shapes and dimensions, such as a diamond shape.

Players 24 of the offensive team sequentially stand at home bunker 11 with one foot in contact with bunker 11 and use a combined paddle and bat or paddle-bat 27 to strike ball 26 into infield 14 or fairfield 23. Players 24 must put ball 26 into play by hitting ball 26 with both ends of paddle-bat 27, or by a B/K. If ball 26 lands in fairfield 23, player or batter 24 can then run from home bunker 11 to first bunker 12. Batter 24 has three tries to hit a fair ball before the batter is out. Also, batter 24 is out if ball 26 lands beyond transverse out line 22 in outfield 21. Players 24 can run between home bunker 11 and first bunker 12, first bunker 12 and second bunker 13, and second bunker 13 and home bunker 11 after hitting a fair ball.

Two or more players 33 and 34 of the defensive team are positioned in infield 14. Three or more players 36, 37 and 38 are positioned in fairfield 23 of playing field 10. Infield players or peggers 33 and 34 can use their hands, feet or other body parts to field or manually collect ball 26 batted by batter 24 and throw or kick ball 26 to safe areas 32 of bunkers 11, 12 and 13 in front of batter 24 running to a bunker 11, 12, 13. For example, batter 24 is safe at first bunker 12 if the ball batter 24 has batted into fairfield 23 is not thrown into safe area 32 of first bunker 12 by peggers 33 and 34 before batter 24 contacts first bunker 12. Batter 24 is out if ball 26 lands in safe area 32 of first bunker 12 before batter 24 contacts first bunker 12.

Figure 6:
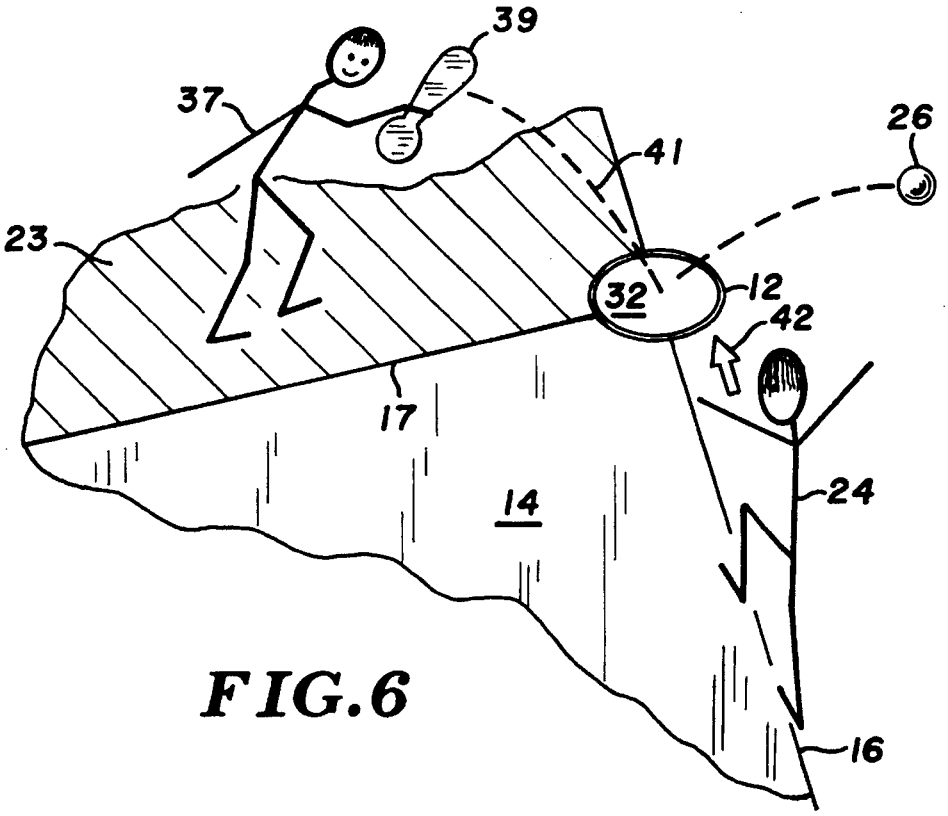
FIG. 6 is a diagrammatic view illustrating a runner put out of the game of the invention.

Fairfield players or beekers 36, 37 and 38 each carry a combined paddle and bat or paddle-bat 39 which they use to collect or field ball 26 in the event ball 26 is hit to fairfield 23 by batter 24. Beekers 36, 37 and 38 cannot touch ball 26 with their hands or body parts. Beekers 36, 37 and 38 use paddle-bats 39 to hit ball 26 toward the safe areas of bunkers 11, 12 and 13 in front of batter 24 running to the bunker. As shown in FIG. 6, beeker 37 uses paddle-bat 39 to hit ball 26 toward safe area 32 of first bunker 12 in front of batter 24 running to first bunker 12, as shown by arrow 42. Player 24 is out when ball 26 lands in safe area 32 of first bunker 12, as shown by broken line 41 in FIG. 6, before player 24 reaches first bunker 12.

Returning to FIG. 1, beekers 36, 37 and 38 can use their paddle-bats 39 to hit ball 26 between each other or to a pegger 33, 34 so that the pegger 33, 34 can throw ball 26 into safe area 32 of first bunker 12 or the safe areas of second bunker 13 and home bunker 11 in front of player 24 running toward a bunker 11–13. When ball 26 is hit using both ends of paddle-bat 39, or a B/K, beekers 36, 37 and 38 earn points for their team when they B/K before a put out.

Figure 2:
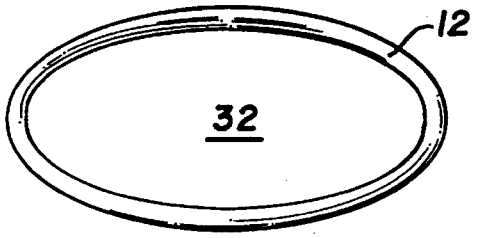
FIG. 2 is a perspective view of a bunker used on the playing field of FIG. 1.

Referring to FIG. 2, bunker 12 is a generally flat annular member that surrounds a circular safe area 32. Bunkers 11 and 13 are annular members having circular safe areas substantially the same as bunker 12. Bunkers 11, 12 and 13 are located at the corners of generally triangular infield 14 of playing field 10.

Figure 5:
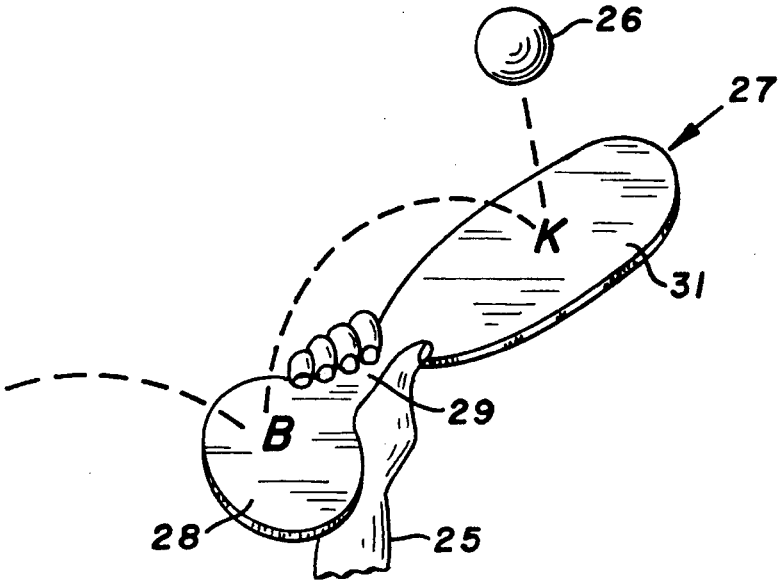
FIG. 5 is a perspective view of the paddle and bat used by the players of the game of the invention.

As shown in FIG. 5, paddle-bat 27 has a lower bat section 28 connected to an upper paddle section 31 with a hand grip section or neck 29. Neck 29 is gripped by hand 25 of player 24. A B/K is completed by first hitting ball 26 with lower bat section 28 and then upper paddle section 31 of paddle-bat 27. Paddle-bats 39 carried by beekers 36, 37 and 38 are substantially the same as paddle-bat 27 used by batter 24. Paddle-bats 27 and 39 are the same as the combined paddle and bat shown and described in U.S. Pat. No. 348,499, issued to J. McAllister on Jul. 5, 1994.

Figure 3:
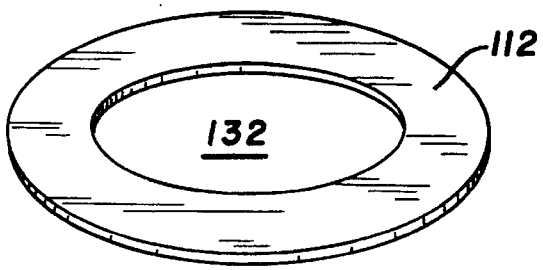
FIG. 3 is a perspective view of a first modification of a bunker useable on the playing field.

Referring to FIG. 3, there is shown a first modification of a bunker useable on playing field 10, indicated at 112. Bunker 112 is a generally flat circular ring or disc 112. Disc 112 surrounds a circular safe area 132.

Figure 4:
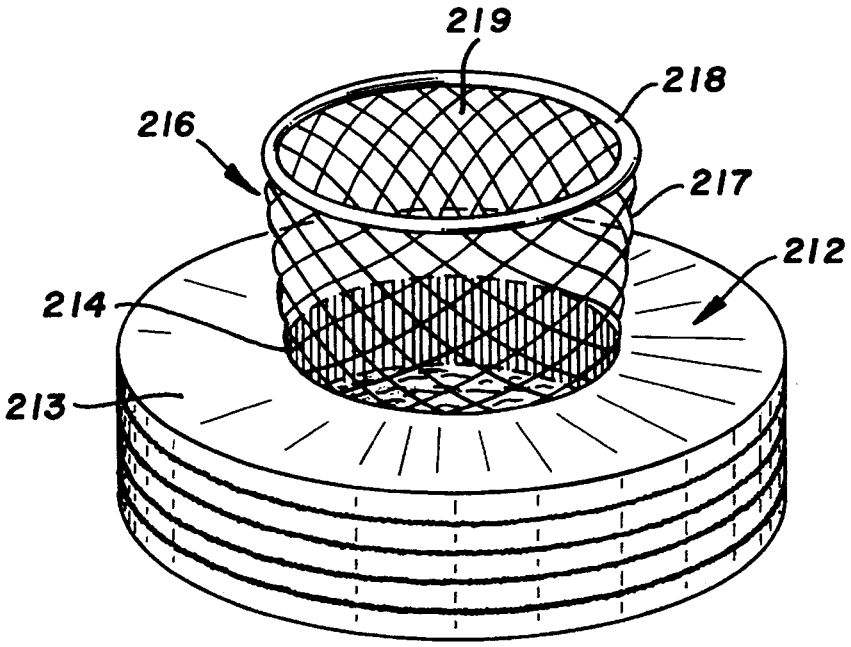
FIG. 4 is a perspective view of a second modification of a bunker useable on the playing field.

Referring to FIG. 4, there is shown a second modification of a bunker useable on playing field 10, indicated generally at 212. Bunker 212 is a generally cylindrical member having an annular generally cylindrical base member 213 with an inner sidewall 214 that surrounds an central opening. A generally cylindrical basket 216 having an open top is located in the opening of base member 213. The diameter of basket 216 is less than the diameter of base member 213. Basket 216 has a mesh sidewall 217 that extends upwardly from base member 213. A lower portion of basket 216 is secured to inner sidewall 214 of base member 213. A generally circular ring 218 attached to the top of basket sidewall 217 surrounds the open top of basket 216. Basket 216 defines a base space 219 into which ball 26 must land before player 24 running to bunker 212 contacts or tags bunker 212 to make a put out.

While there has been shown and described preferred embodiments of the paddle and bat ball game and game apparatus of the invention, it is understood that changes in the size, materials and arrangement of parts can be made that are within the scope and function of the invention as set out in the following claims.

I claim:

1. A game and apparatus for first and second teams of players wherein the apparatus comprises first bunker means for a home safe area, second bunker means for a first safe area, third bunker means for a second safe area, a ball, first paddle means used by players of the first team for hitting the ball, second paddle means used by players of the second team to hit the ball, and playing surface means providing a playing field for the teams of players comprising a generally triangular infield, and a fairfield adjacent one side of the infield, said players of the first team sequentially using the first paddle means to hit the ball into the infield or fairfield and then run from the first bunker means to the second bunker means, said players of the second team being positioned in the infield and fairfield, said players in the infield manually collecting the ball and throwing the ball to the safe area of the second bunker means in front of the player of the first team running to the second bunker means, said player of the first team being safe at the second bunker means in the event the ball does not land in the safe area of the second bunker means before the player contacts said second bunker and out in the event the ball lands in the safe area of the second bunker means before the player contacts the second bunker means, said players in the fairfield collecting the ball in the event it is hit to the fairfield and using the second paddle means to hit the ball toward the safe area of the second bunker means in front of the player of the first team running to said second bunker means, said player of the first team being safe at the second bunker in the event the ball does not land in the safe area of the second bunker means before the player reaches the second bunker means and out in the event the ball lands in the safe area of the second bunker means before the player reaches the second bunker means.

2. The game and apparatus of claim 1 wherein: the first, second, and third bunker means are annular members surrounding said safe areas.

3. The game and apparatus of claim 1 wherein: the first, second, and third bunker means are located at the corners of the generally triangular infield of the playing field.

4. The game and apparatus of claim 1 wherein: the first, second, and third bunker means are circular rings surrounding said safe areas.

5. The game and apparatus of claim 1 wherein: the first, second, and third bunker means each have a cylindrical base and a basket having an open top secured to said base.

6. The game and apparatus of claim 1 wherein: the players in the fairfield use the second paddle means to hit the ball to the players in the infield whereby the players in the infield throw the ball to the safe area of the second bunker means or the safe areas of the third or first bunker means in front of the player running toward a bunker means.

7. The game and apparatus of claim 1 wherein: each paddle means has an upper paddle section, a lower bat section and a hand grip section located between the paddle section and bat section.

8. The game and apparatus of claim 1 wherein: the paddle means is a combination paddle and bat.

9. A game and apparatus for first and second players wherein the apparatus comprise a plurality of bunker means having safe areas for players, a ball, first means used by the first player to hit the ball, second means used by the second player to hit the ball and playing surface means providing a playing field for the players, said field including an infield and a fairfield, said bunker means being spaced about the infield, said first player using the first means to hit the ball into the infield or fairfield and then run from one bunker means toward a second bunker means, said second player being positioned in the playing field to collect the ball and send the ball toward the safe area of the second bunker means in front of the first player running to the safe area of the second bunker means, said first player being safe at the second bunker means in the event that the ball does not land in the safe area of the second bunker means before the first player contacts the second bunker means and out in the event the ball lands in the safe area of the second bunker means before the player contacts the second bunker means.

10. The game and apparatus of claim 9 wherein: the second player in the fairfield uses the second means to hit the ball toward the safe area of the second bunker means.

11. The game and apparatus of claim 9 wherein: each bunker means is an annular member.

12. The game and apparatus of claim 9 wherein: each bunker means is a circular ring.

13. The game and apparatus of claim 9 wherein: each bunker means has a cylindrical base and a basket having an open top secured to said base.

14. The game and apparatus of claim 9 wherein: the infield has a generally triangular shape.

15. The game and apparatus of claim 9 wherein: the first means and second means each has a paddle section, a bat section and a hand grip section located between the paddle section and bat section.

16. The game and apparatus of claim 9 wherein: the first means and second means is a combination paddle and bat.

* * * * *